United States Patent [19]

Moreno

[11] Patent Number: 4,850,565

[45] Date of Patent: Jul. 25, 1989

[54] POST SUPPORT

[76] Inventor: Albert M. Moreno, 395 W. Walker St., East Flat Rock, N.C. 28726

[21] Appl. No.: 145,699

[22] Filed: Jan. 15, 1988

Related U.S. Application Data

[63] Continuation of Ser. No. 859,655, May 5, 1986, abandoned.

[51] Int. Cl.[4] ..... F16M 13/00

[52] U.S. Cl. ..... 248/545; 248/530; 248/548; 248/900; 248/156

[58] Field of Search ..... 248/545, 548, 551, 530, 248/156, DIG. 9, 508, 87, 85, 900; 52/155, 157, 165, 98; 40/607, 608, 612; 403/2

[56] References Cited

U.S. PATENT DOCUMENTS

| | | | |
|---|---|---|---|
| 254,662 | 3/1882 | Kinney | 52/155 |
| 1,373,560 | 4/1921 | Holland | 248/156 X |
| 3,011,598 | 12/1961 | Galloway et al. | 52/157 X |
| 3,342,444 | 9/1967 | Nelson | 248/530 X |
| 3,349,531 | 10/1967 | Watson | 403/2 X |
| 3,355,998 | 12/1967 | Roemisch | 403/2 |
| 3,698,144 | 10/1972 | Stratton | 403/2 X |
| 3,912,404 | 10/1975 | Katt | 403/2 |
| 4,290,245 | 9/1981 | Pardue, Jr. et al. | 52/165 X |
| 4,593,872 | 6/1986 | Svensson | 248/530 X |
| 4,603,520 | 8/1986 | Deike | 52/157 X |

*Primary Examiner*—Ramon S. Britts
*Assistant Examiner*—Karen J. Chotkowski
*Attorney, Agent, or Firm*—Bailey & Hardaway

[57] ABSTRACT

A post and ground support is illustrated utilizing a helical member forming an auger for digging the ground support into the earth, and easily removing the ground support from the ground and re-using said support in another location. The ground support includes a ground engaging stabilizing member affording resistance to a force having a component at right angles to the post, and a breakaway connection is provided between the ground support member and the post, together with a connection for retaining the post in a position near the ground support after separation therefrom. The breakaway connection positions the post upon the ground support above the ground and separates in response to a force coming from any direction about the post.

6 Claims, 4 Drawing Sheets

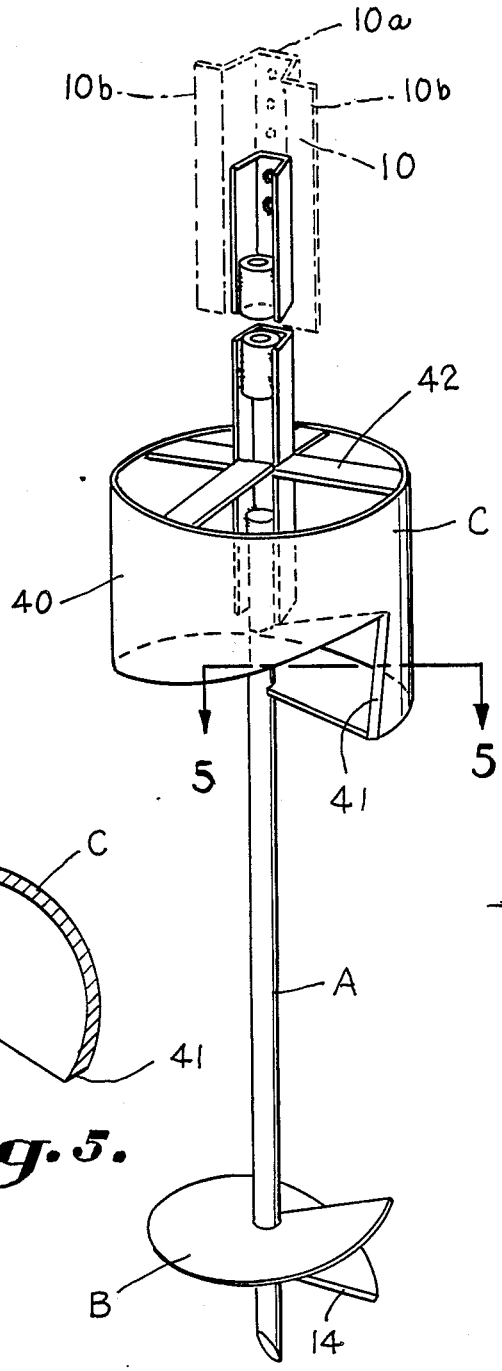
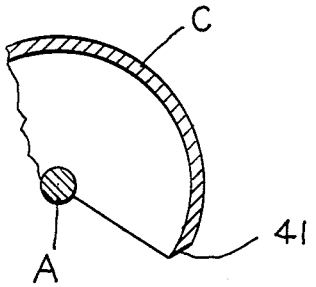
Fig. 5.
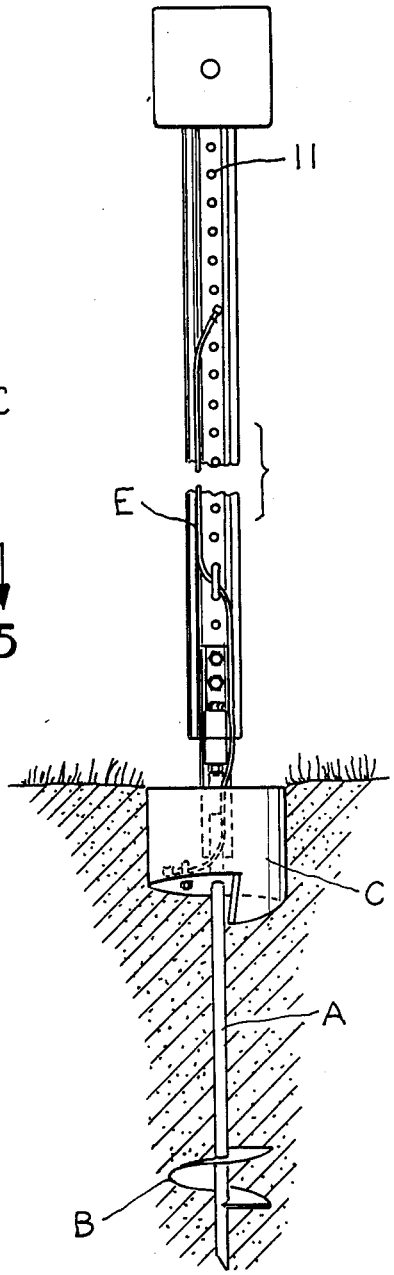
Fig. 4.
Fig. 6.

POST SUPPORT

This application is a continuation, of application Ser. No. 859,655, filed 5/5/86 now abandoned.

BACKGROUND OF THE INVENTION

Ground supported posts, such as those carrying highway signs and reflectors, have been provided with breakaway members such as illustrated in U.S. Pat. Nos. 3,820,906 and 4,126,403. Such breakaway structures provide for a separation of the post from a base support when being struck in either of two directions, front or back. An angular blow damage to the post which becomes twisted or bent. U.S. Pat. No. 3,355,998 discloses a shank which is threaded on both ends with a groove therebetween for facilitating separation together with an intermediate ring for assuring proper positioning of the groove. The posts upon separation from the bases are often separated over distances as may result in the posts becoming lost or stolen.

For further example, highway posts are often embedded in the earth by utilizing a concrete base anchor for retaining the post support within the earth. Such constructions are expensive, for large holes must be dug and filled with concrete before setting the post therein.

Posts of the type utilized on the highway are often damaged because the portion extending out of the ground is often struck at bumper height to cause the post to be bent over or otherwise damaged so that its usefulness is impaired necessitating replacement at substantial expense.

Accordingly, it is an important object of this invention to provide an improved post support structure which is illustrated herein in the form of a highway post having the familiar U-shaped flanged configuration although other post may be advantageously constructed in accordance with the invention.

Another important object of this invention is the provision of a ground support for a post which may be readily embedded in the earth through the use of a helical member forming an auger and wherein a ground engaging member is provided for stabilizing the post against a force as may be exerted by the bumper of a vehicle.

Another important object of the invention is the provision of a breakaway construction of simplified construction for connecting a post with a ground support member which may be broken away or sheared off by a force coming from any direction 360 degrees thereabout.

Another important object of the invention is the provision of a connecting apparatus for securing the post to a ground support member from which it may be separated in such a way that suitable slack is provided to permit the post to engage or even lie flat upon the earth but retain same close enough to the support to prevent loss or pilferage.

SUMMARY OF THE INVENTION

It has been found that a post and ground support may be provided utilizing a rod carrying a helical member forming an auger. Ground engaging stabilizing means are provided by a suitable ground engaging member above the helix and carried upon the rod. Preferably this may be a finned member or a collar having a vertical surface for engaging the earth for resisting a force having a right angle component. A breakaway member is provided for separating the post from the ground support without substantial injury to the post in response to a force exerted as at bumper height at any angle around the post. The breakaway member has a pair of opposed abutments having vertical aligned base members thereon when the abutments are placed in back to back relation for retaining a shank member which may be sheared away between the opposed abutments between the opposed base member. A cable connects the post to the ground support having suitable slack to retain the post when the breakaway member has been fractured so as to separate the post from the ground support.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a perspective view illustrating a modified form of the invention utilizing a fixed collar or circumferential wall acting as a ground engaging stabilizing member;

FIG. 5 is an enlarged sectional plan view taken on the line 5—5 in FIG. 4;

FIG. 6 is a side elevation illustrating a post support constructed in accordance with the invention having a stabilizing member of FIGS. 4 and 5.

DESCRIPTION OF A PREFERRED EMBODIMENT

The drawings illustrate a post and ground support therefor. The ground support includes an elongated rod A. A helical member B is carried at one end of the rod forming an auger. A ground engaging stabilizing member C is carried by the elongated rod above the helical member affording resistance to a force having a component at right angles to the rod when embedded in the ground. Suitable means connect the post to the rod above said stabilizing member. Such may be an integral connection or breakaway means including an elongated shearable shank D which may be provided for separating the post from the ground support. A cable E having connection on one end to the ground support and on the other end to the post provide a slack portion connecting the post to the ground support when separated therefrom responsive to a force upon the post.

Figure 2:
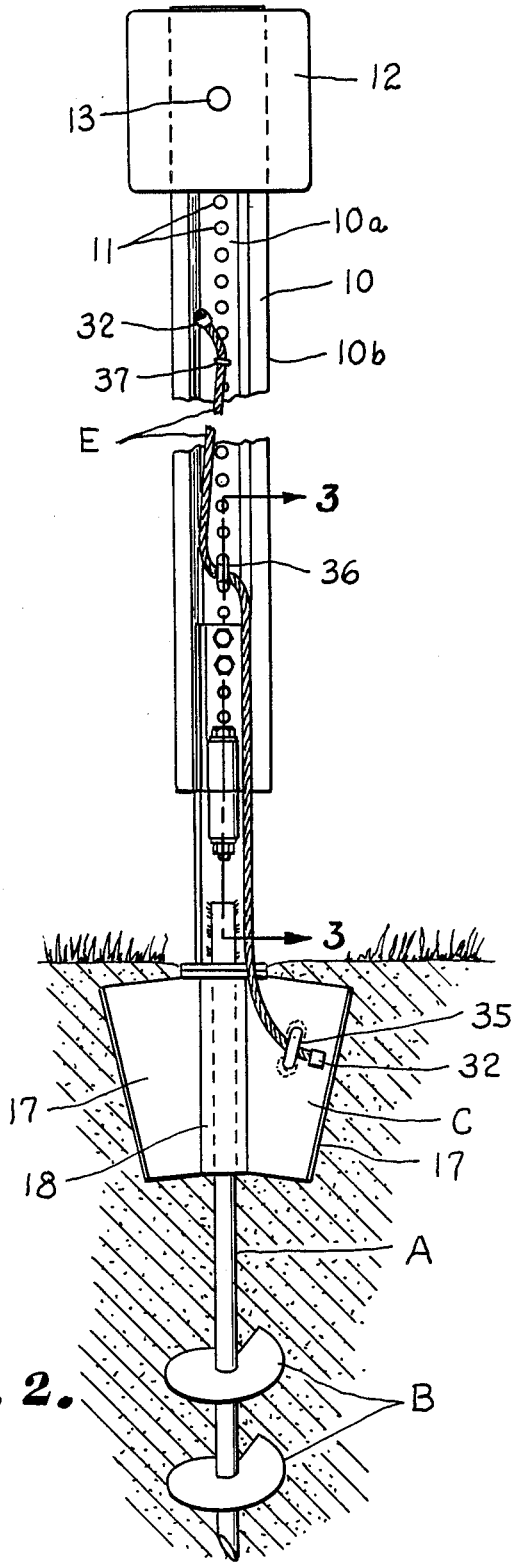
FIG. 2 is a front elevation illustrating the post support of FIG. 1 installed in the earth.

The post illustrated in the drawings is of the type commonly seen on highways, although any other type of post may be advantageously used. The post 10 includes a channel-shaped portion 10*a*, together with diverging flanges 10*b*. The channel-shaped portion has a number of vertically spaced holes 11. A reflector member at 12 is suitably secured as by a screw 13 adjacent the top of the post as illustrated in FIG. 2. The auger B includes helical members having a beveled forward edge 14 for entering the earth much like a saw tooth. The helical members together with the bar member A forms an auger for digging into the earth when the bar A is rotated.

Figure 1:
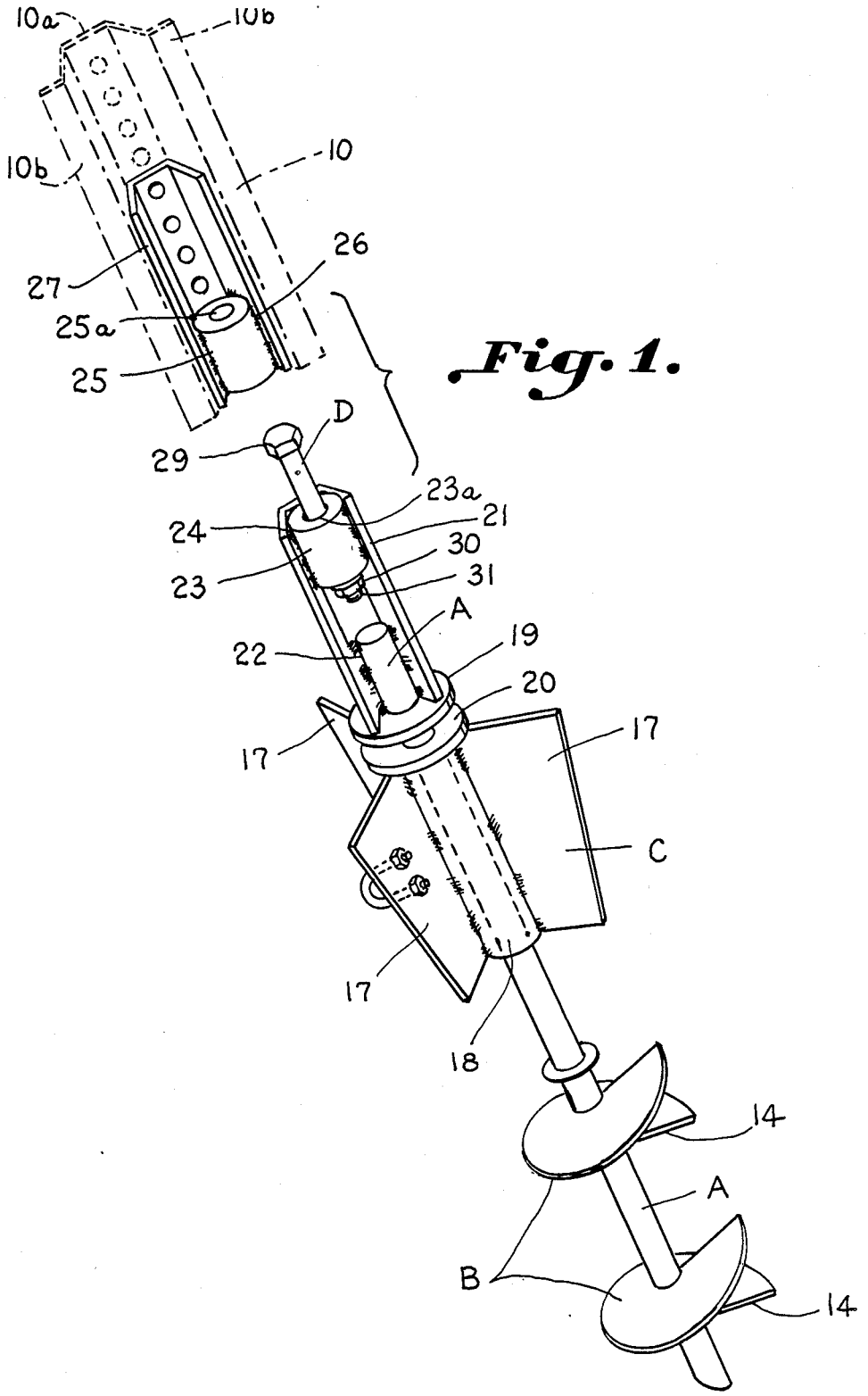
FIG. 1 is a perspective view illustrating a post support constructed in accordance with the present invention having an auger and a vertical slideable finned ground engaging member carried on a rod above the auger portion providing a member extending above the earth to accommodate the breakaway member which includes an elongated shank.
Figure 3:
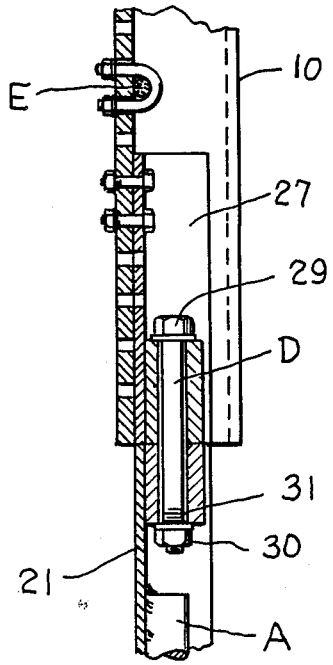
FIG. 3 is an enlarged transverse sectional elevation taken on the line 3—3 in FIG. 2.

The stabilizing member C may assume the configuration illustrated in FIGS. 1 and 2 wherein circumferentially spaced fins 17 provide a vertical portion for bearing against the earth to oppose a force at right angles tending to dislodge the sign. The fins 17 are carried by a collar 18 which is slideably mounted upon an immediate portion of the rod A above the auger portion. The rod A extends above the stabilizer and carries a disk 19 fixed thereon to oppose a disk 20 carried adjacent the top of the slideable or floating stabilizing member C.

The rod A carries a channel-shaped member 21 fixed to the rod A as by welding as at 22. An abutment member 23 is generally cylindrical and is fixed as by welding 24 adjacent an upper end of the channel member 21. A second opposed abutment 25 is fixed as by welding 26 to a channeled portion 27 for securement within the bottom of the post. The cylindrical members 23 and 25 have respective vertical bores 23*a* and 25*a* which are in alignment to carry the shank member D. The shank D carries enlarged bearing members 29 and 30 for bearing on opposite ends of the abutments 25 and 23 respectively. The bearing member 29 is integral whereas the lower bearing member 30 may be threadably carried as at 31 upon an end of the shank, for easy positioning and assembly.

Figure 7:
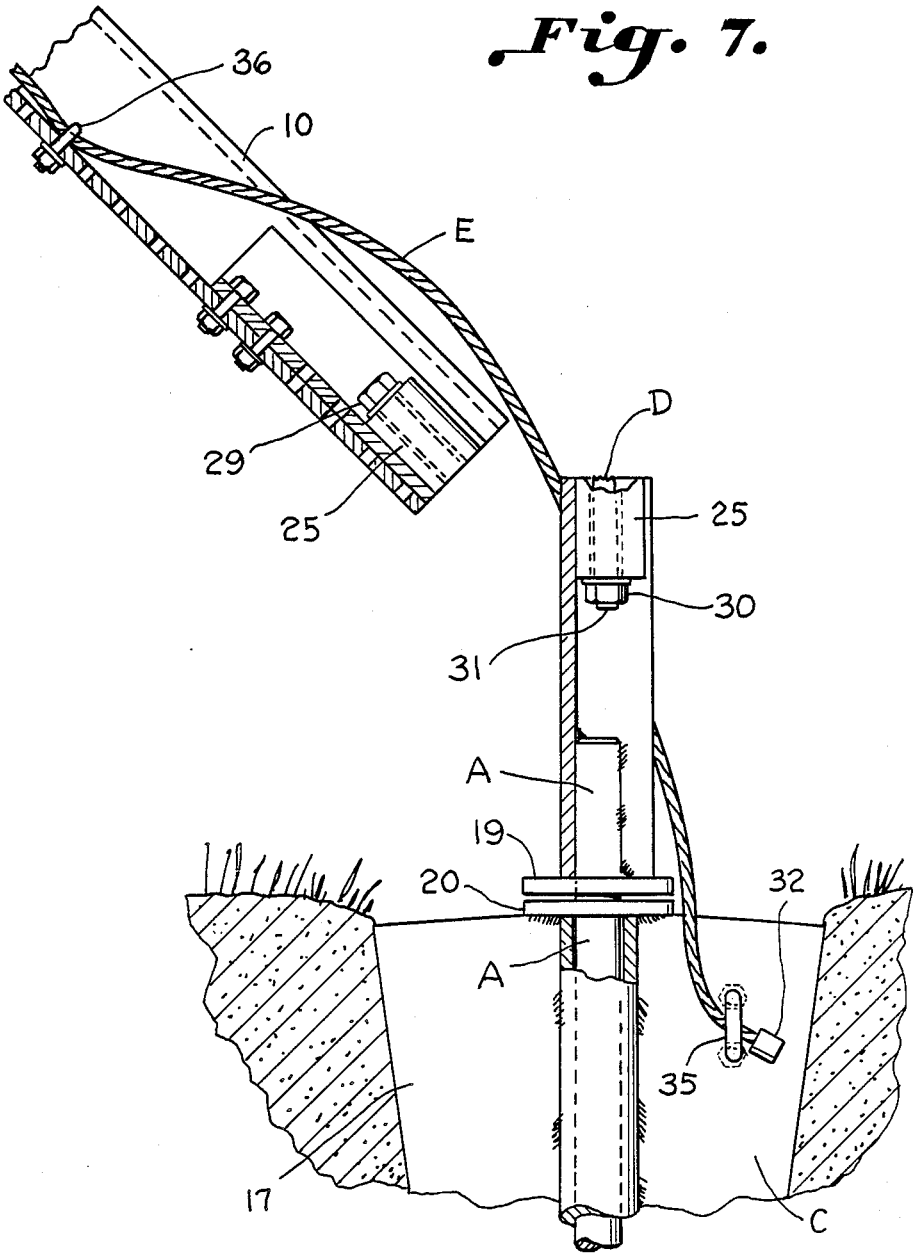
FIG. 7 is a front elevation illustrating a post and ground support wherein the breakaway member includes a sheared shank or pin member, and wherein a cable is provided for maintaining a connection between the post and the ground support.

A cable E is provided which has enlarged bearing member 32 adjacent each end. The cable provides sufficient slack to permit the post to be sheared away from the base support as illustrated in FIG. 7 by preventing same from becoming dislodged or thrown into the road as may impede vehicles or become so far removed as to be lost or stolen. The cable E extends through a pair of U bolts 35 and 36, and an upper part thereof, which constitutes slack, may be secured as through the use of a cotter pin 37 and the like to lie flat within the channel portion of the post. The U bolt 36 serves as a hold-down member to engage the bearing member 32 for forming the connection when the post is separated from the support.

A modified form of vertical stabilizer is illustrated in FIGS. 4 through 6 which includes a circumferential wall 40 which carries a beveled cutting edge 41 which incline outwardly from top to bottom as illustrated in FIG. 4 to facilitate cutting as in a saw tooth. The beveled or chamfered edge 41 pushes the earth outwardly so that a firm bearing is achieved between wall 40 and undisturbed earth. The upper portion of circumferential member 40 is braced as at 42 and connected to an upper portion of the ground support portion. Such a construction has the advantage of inhibiting the growth of grass from being mowed around the post. In each embodiment of the stabilizing member illustrated a wall portion extends beyond the helical members of the auger portion so as to bear upon undisturbed earth.

While a preferred embodiment of the invention has been described using specific terms, such description is for illustrative purposes only, and it is to be understood that changes and variations may be made without departing from the spirit or scope of the following claims.

What is claimed is:

1. A breakaway device for mounting an upright post upon a ground support carried within the earth comprising:

a first abutment carried by said ground support at an upper end thereof having an opening therein in alignment with said ground support;

a separate second abutment carried by said post at a lower end thereof having an opening therein in alignment with said post;

said first and second abutments having respective upper and lower surfaces carried in opposed relation;

said first and second abutments each having a bearing surface remote from respective upper and lower surfaces;

a shank member carrying a bearing member adjacent each end in bearing relation with respective bearing surfaces drawing said abutments toward each other; and said shank member consisting essentially of a single shear pin thereby joining said post and said ground support which may be sheared away in response to a force having a right angled component applied to the post from any direction thereabout.

2. For use in mounting an upright post upon a ground support, a breakaway device comprising:

breakaway means mounting said post upon said ground support including a single shear pin having an elongated vertical shank;

means for positioning said shear pin between said upright post and said ground support affording substantially the same resistance to a force from any direction;

a flexible cable means external to said breakaway means attached adjacent one end to said ground support and adjacent the other end to said post; and said flexible cable means having a length for providing slack sufficient to avoid loading until shearing has occurred as a result of a force from any direction affording substantially the same resistance to said force in all directions to permit the post upon being broken away and separated from said ground support to lay upon the ground, but restraining said post from separation from the ground support beyond a predetermined distance.

3. The structure set forth in claim 1 including threadable means urging said abutments toward each other.

4. An upright support comprising:

an elongated rod;

a ground engaging stabilizing member including a vertical circumferential wall open at a bottom portion extending outwardly of said elongated rod carried by said elongated rod affording resistance to a force having a component at right angles to said rod when embedded in the ground;

means bracing said wall and connecting same adjacent a top thereof adjacent an upper portion of said rod; and a helical cutting edge carried by a lower portion of said vertical circumferential wall and in vertical alignment therewith.

5. The structure set forth in claim 4 including a helical member having a helical cutting edge carried at one end of the rod forming an auger.

6. The structure set forth in claim 4 including;

a post;

breakaway means connecting said post to said rod above said stabilizing member; and said breakaway means including a single shear pin which may be broken away in response to said force having a right angled component applied to the post from any direction thereabout.

* * * * *